US005595611A

United States Patent [19]

Boulos et al.

[11] Patent Number: 5,595,611

[45] Date of Patent: Jan. 21, 1997

[54] MODERATE TEMPERATURE MANGANESE PHOSPHATE CONVERSION COATING COMPOSITION AND PROCESS

[75] Inventors: Mervet S. Boulos, Troy; David C. Montrose, St. Clair Shores; Michael Petschel, Rochester Hills, all of Mich.

[73] Assignee: Henkel Corporation, Plymouth Meeting, Pa.

[21] Appl. No.: 601,481

[22] Filed: Feb. 14, 1996

[51] Int. Cl.[6] ..... C23C 22/18

[52] U.S. Cl. ..... 148/259; 148/262

[58] Field of Search ..... 148/262, 259

[56] References Cited

U.S. PATENT DOCUMENTS

| | | | |
|---|---|---|---|
| 2,132,000 | 10/1938 | Curten | 148/262 |
| 3,767,476 | 10/1973 | Wagner | 148/262 |
| 4,941,930 | 7/1990 | Charles | 148/260 |
| 5,045,130 | 9/1991 | Gosset | 148/262 |
| 5,261,973 | 11/1993 | Sienkowski | 148/260 |

FOREIGN PATENT DOCUMENTS

| | | | |
|---|---|---|---|
| 123882 | 7/1983 | Japan | 148/262 |

*Primary Examiner*—Sam Silverberg

*Attorney, Agent, or Firm*—Ernest G. Szoke; Wayne C. Jaeschke; Norvell E. Wisdom, Jr.

[57] ABSTRACT

An aqueous solution of manganese phosphate and phosphoric acid, preferably with little or no content of any material conventionally recognized as an accelerator or of any divalent metal ions other than manganese and iron, forms a good quality paint undercoating phosphate conversion coating on metal substrates, particularly on steel and galvanized steel substrates, when contacted by spraying or immersion with the substrates at a temperature of 54°–65° C. for a time of 2–5 minutes.

8 Claims, No Drawings

MODERATE TEMPERATURE MANGANESE PHOSPHATE CONVERSION COATING COMPOSITION AND PROCESS

BACKGROUND OF THE INVENTION

1. Field of the Invention

This invention relates to compositions and processes for depositing a manganese containing phosphate conversion coating on metal surfaces, particularly the surfaces of ferrous metals, galvanized steel, and other predominantly zinciferous surfaces. The invention particularly relates to such compositions and processes that produce, at a temperature not more than 80° C., a conversion coating suitable as a high quality undercoat for paint and like organic coatings.

2. Statement of Related Art

The general process of phosphate conversion coating is well known in the art. See, e.g., M. Hamacher, "Ecologically Safe Pretreatments of Metal Surfaces", Henkel-Referate 30 (1994), pp. 138–143, which, except to the extent that it may be contrary to any explicit statement herein, is hereby incorporated herein by reference. In brief, contact of active metals such as iron and zinc with aqueous acidic compositions containing a sufficient concentration of phosphate ions results in the deposition on the active metal surfaces of a conversion coating containing phosphate ions and some metallic cations, which are derived from dissolution of the active metal being phosphate conversion coated, from metallic cations with a valence of at least two that are present in the aqueous acidic compositions, or both. In many instances, particularly when the phosphating compositions contain zinc, nickel, or manganese, in order to speed the process and improve the uniformity of the coating, it is customary to include in the coating composition a component called an "accelerator" that does not usually become incorporated into the coating formed. Typical widely used accelerators include nitrite and chlorate ions, water soluble nitroaromatic organic compounds such as p-nitrobenzene sulfonic acid, and hydroxylamine, the latter almost always in the form of salts or complexes and different from most other accelerators because, in the concentrations in which it is normally used, it is not a strong enough oxidizing agent to oxide Fe(II) ions to Fe(III) ions, one of the functions of most other accelerators.

Prior art phosphating compositions that include manganese as substantially the only metal cations with a valence of two or more in the compositions have been known and used. However, such compositions have been previously used in practice only at relatively high temperatures, almost always above 80° C. and more often above 88° C. Such compositions have been notoriously prone to sludging, a phenomenon that occurs with almost all phosphate conversion coating compositions but is quantitatively aggravated when the compositions contain manganese as the predominant cations with a valence of two or more.

Furthermore, such prior art manganese based conversion coatings have been normally used only to deposit heavy and usually amorphous conversion coatings that function primarily as lubricant carriers during cold working of the metal objects underlying the conversion coatings formed. Although this is one important practical application of phosphating, providing an undercoat for paints is still more important and in the past has not been advantageously accomplished by phosphating compositions in which divalent manganese ions were substantially the only metal cations present with a valence of two or more: The thick phosphate conversion coatings readily achieved with manganese phosphating compositions are too thick and/or brittle to provide good adhesion to subsequently applied paint and like materials, presumably because thick manganese phosphate coatings are readily cracked by even fairly small mechanical shocks. On the other hand, controlling manganese phosphating compositions to produce the thinner, usually microcrystalline types of phosphate conversion coatings that do provide good adhesion to subsequently applied paint and are readily produced by phosphating compositions that contain zinc, nickel, cobalt, and/or iron in a total amount of at least 0.5 grams per liter (hereinafter usually abbreviated as "g/L") has proved practically difficult if not impossible with manganese phosphating compositions.

Also, prior art manganese phosphating compositions are not known to have produced satisfactory quality conversion coatings when contacted with the surfaces to be coated by spraying only, and have generally been used only when the surfaces to be coated were immersed in the compositions.

DESCRIPTION OF THE INVENTION

Object of the Invention

Various alternative and/or concurrent objects of this invention are: (i) to provide a composition and process for phosphating that will provide a high quality protective undercoat for paint and like organic binder containing overcoatings, where manganese ions are the predominant cations with a valence of two or more in the composition; (ii) to provide manganese containing phosphate conversion coatings readily controlled to lower coating masses of manganese per unit area coated than have been usual with prior art manganese phosphate conversion coating compositions; (iii) to provide relatively economical phosphate conversion coating compositions and processes that will provide as good quality paint undercoatings as do currently conventional phosphate conversion coating processes utilizing zinc, nickel, and/or cobalt containing conversion coating forming compositions; (iv) to provide conversion coatings with good paint undercoating quality by spraying; (v) to reduce the pollution hazard from phosphating compositions by (v.1 ) reducing or eliminating their content of zinc, nickel, cobalt, chromium, copper, and/or other "heavy metals" other than manganese and/or (v.2) decreasing volumes of sludge formed during use of the phosphating compositions; and (vi) to provide conversion coatings with good paint undercoating quality at a phosphating temperature not greater than 70° C. Other objects will be apparent from the description below.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole; any counterions thus implicitly specified should preferably be selected from among other constituents explicitly specified in ionic form, to the extent possible; otherwise such counterions may be freely selected, except for avoiding counterions that act adversely to the objects of the invention; the terms "molecule" and "mole" and their grammatical variations may be applied to ionic, elemental, or any other type of chemical entities defined by the number of atoms of each type present therein, as well as to substances with well-defined neutral molecules; the first definition of an acronym or other abbreviation applies to all subsequent uses herein of the same abbreviation and applies mutatis mutandis to normal grammatical variations of the initially defined abbreviation; the term "paint" includes all like materials that may be designated by more specialized terms such as lacquer, enamel, varnish, shellac, and the like; and the term "polymer" includes "oligomer", "homopolymer", "copolymer", "terpolymer", and the like.

SUMMARY OF THE INVENTION

It has been found that one or more of the objects stated above for the invention can be achieved by the use of a conversion coating forming aqueous liquid composition that has a pH of at least 3.0 and comprises, preferably consists essentially of, or more preferably consists of, water and:

(A) dissolved divalent manganese cations; and (B) dissolved phosphate anions; and, optionally, one or more of the following:

(C) a dissolved component selected from the group consisting of organic acids and anions thereof that (1) contain at least two moieties per molecule that are selected from the group consisting of (i) carboxyl and carboxylate moieties, (ii) hydroxyl moieties that are not part of a carboxyl moiety, and (iii) phosphonic acid and phosphonate moieties and (2) are not part of any of the previously recited components;

(D) a component of dissolved acids that are not part of any of the previously recited components;

(E) a component of dissolved reducing agent and/or reaction products therefrom that are not part of any of the previously recited components;

(F) a component of surfactant that is not part of any of the previously recited components;

(G) a dissolved component selected from the group consisting of simple and complex anions that contain fluorine atoms and are not part of any of the previously recited components;

(H) a component of dissolved metal cations, with a valence of at least two, that are not part of any of the previously recited components;

(J) buffering agents that are not part of any of the previously recited components; and (K) biocides that are not part of any of the previously recited components.

Various embodiments of the invention include working compositions for direct use in treating metals, make-up concentrates from which such working compositions can be prepared by dilution with water, replenisher concentrates suitable for maintaining optimum performance of working compositions according to the invention, processes for treating metals with a composition according to the invention, and extended processes including additional steps that are conventional per se, such as cleaning, activation of the surface to be conversion coated before it is contacted with the conversion coating composition (e.g., activation of steel with titanium phosphate sols, also known as "Jernstedt salts"), rinsing, and subsequent painting or some similar overcoating process that puts into place an organic binder containing protective coating over the metal surface treated according to a narrower embodiment of the invention. Articles of manufacture including surfaces treated according to a process of the invention are also within the scope of the invention.

DESCRIPTION OF PREFERRED EMBODIMENTS

For a variety of reasons, it is sometimes preferred that compositions according to the invention as defined above should be substantially free from many ingredients used in compositions for similar purposes in the prior art. Specifically, when maximum storage stability of a concentrate, avoidance of possibly troublesome anions, economy, and/or minimization of pollution potential is desired, it is preferred, with increasing preference in the order given, independently for each preferably minimized component listed below, that these compositions contain no more than 25, 15, 9, 5, 3, 1.0, 0.35, 0.10, 0.08, 0.04, 0.02, 0.01, 0.001, or 0.0002, percent of each of the following constituents: nitrite; halates and perhalates (i.e., perchlorate, chlorate, iodate, etc.); hydroxylamine and salts and complexes of hydroxylamine; chloride; bromide; iodide; organic compounds containing nitro groups; hexavalent chromium; manganese in a valence state of four or greater; metal cations, other than manganese and iron, with a valence of two or more; ferricyanide; ferrocyanide; and pyrazole compounds. Components such as these may not be harmful in some cases, but they have not been found to be needed or advantageous in compositions according to this invention, and their minimization is therefore normally preferred at least for reasons of economy. Further and independently, in contrast to most other phosphating compositions and processes, it is preferred that working phosphating compositions according to this invention should have an oxidizing power no greater than that which is inherent in an otherwise preferred composition according to the invention, with other ingredients explicitly specified as necessary or preferred, that is in equilibrium with the natural atmospheric gases. The oxidizing power of the composition may be measured for this purpose by the potential of a platinum electrode immersed in the composition, compared to some standard reference electrode maintained in electrical contact with the composition via a salt bridge, flowing junction, semipermeable membrane, or the like as known to those skilled in electrochemistry.

The dissolved manganese cations required for necessary component (A) may be obtained from any soluble manganese salt or from manganese metal itself or any manganese containing compound that reacts with aqueous acid to form dissolved manganese cations. Normally preferred sources, largely for economic reasons, are manganese carbonate and manganese oxide. (If manganese oxide is used to prepare a concentrate composition according to the invention, the presence of reducing agent component (E) as defined above is usually preferred, because without it the dissolution rate of MnO in phosphoric acid is very slow. Reducing agents appear to act in a catalytic or at least partially catalytic manner to speed the dissolution process, inasmuch as the amount of reducing agent needed to make the dissolution rate of MnO practically fast is far less than the amount that would be stoichiometrically required to react with all the manganese present.)

In a working conversion coating forming aqueous liquid composition according to the invention, the concentration of dissolved manganese cations preferably is at least, with increasing preference in the order given, 0.1, 0.2, 0.30, 0.40, 0.50, 0.60, 0.70, 0.80, 0.90, 1.00, 1.10, 1.20, 1.30, 1.35, 1.40, 1.45, or 1.49 parts per thousand (hereinafter usually abbreviated as "ppt") and independently preferably is not more than, with increasing preference in the order given, 4.0, 3.5, 3.0, 2.7, 2.5, 2.3, 2.2, 2.1, or 2.0 ppt. Smaller concentrations than those recited as preferred minimums above generally do not produce satisfactory coatings in a reasonable time. Larger concentrations than those recited as preferred maximums above generally do not produce any quality improvement in the coatings formed and are therefore uneconomical.

The dissolved phosphate ions that constitute necessary component (B) also may be obtained from a variety of sources as known in the general phosphate conversion coating art. Because of a preference noted below- for a substantial amount of total acid in a working conversion coating forming aqueous liquid composition according to the invention, normally much of the phosphate ion content will preferably be supplied by phosphoric acid added to the composition, and the stoichiometric equivalent as phosphate ions of all undissociated phosphoric acid and all its anionic ionization products in solution, along with the stoichiometric equivalent as phosphate ions of any dihydrogen phosphate, monohydrogen phosphate, or completely neutralized phosphate ions added to the composition in salt form, are to be understood as forming part of component (B), irrespective of the actual degree of ionization that exists in the composition. If any metaphosphoric acid or condensed phosphoric acids or their salts are present in the compositions, their stoichiometric equivalent as phosphate is also considered part of component (B). Generally, however, it is preferred to use orthophosphoric and its salts only for component (B).

In a working conversion coating forming aqueous liquid composition according to the invention, the concentration of component (B) preferably is at least, with increasing preference in the order given, 5, 6, 7, 8, 9, 10, 10.5, 11.0, 11.5, 11.8, 12.0, 12.2, 12.4, or 12.6 ppt and independently preferably is not more than, with increasing preference in the order given, 100, 50, 40, 30, 27, 24, 21, 19.0, 18.0, 17.0, 16.0, 15.0, 14.0, 13.7, 13.3, 13.0, or 12.8 ppt.

Independently of the other preferences, the ratio of the concentration of component (A) to the concentration of component (B) in a conversion coating forming aqueous liquid composition according to the invention, whether working or concentrate, preferably is at least, with increasing preference in the order given, 1.0:50, 1.0:40, 1.0:35, 1.0:30, 1.0:27, 1.0:24, 1.0:21, 1.0:18, 1.0:16, 1.0:15, 1.0:14, or 1.0:13.7 and independently preferably is not more than, with increasing preference in the order given, 1.0:5.0, 1.0:6.0, 1.0:7.0, 1.0:8.0, 1.0:8.5, 1.0:9.0, 1.0:9.5, 1.0:10, 1.0:10.5, 1.0:11.0, 1.0:11.5, 1.0:12.0, 1.0: 12.5, 1.0: 13.0, or 1.0: 13.3.

Component (C), one of the important functions of which when used is to sequester calcium and magnesium ions that might be present in the water supply, normally is preferably present in compositions according to the invention and is preferably derived from anions or other molecules each of which contains both at least one carboxyl(ate) moiety and one hydroxyl moiety that is not part of any carboxyl(ate) moiety, more preferably from the group consisting of citric acid, gluconic acid, and heptogluconic acid and the water soluble salts of all of these acids, most preferably from gluconic acid and its water soluble salts. Independently, the concentration of component (C) in a working conversion coating forming aqueous liquid composition according to the invention preferably is at least, with increasing preference in the order given, 0.4, 0.8, 1.5, 2.0, 2.5, 3.0, 3.5, 4.0, 4.3, 4.6, 4.8, or 5.0 millimoles per liter of total composition (hereinafter usually abbreviated as "mM/P") and independently, primarily for reasons of economy, the concentration of component (C) in a working composition according to the invention preferably is not more than, with increasing preference in the order given, 50, 25, 15, 10, 7.0, 5.8, 5.5, or 5.2 mM.

Nitric acid is preferably present in a composition according to the invention, most preferably as the sole constituent of component (D), but other acids can also be present in the compositions according to the invention. The major recognized purpose of component (D) is to increase the "Total Acid" content of compositions according to the invention above the levels that can be achieved with phosphoric acid alone without exceeding the above noted preferred maximum values for phosphate ions. The Total Acid content, consistent with general practice in the art, is measured in "points", which are defined for the purposes of this description to be equal to the milliliters ("ml") of 0.1N NaOH required to titrate a 10 ml aliquot sample of the composition to a pH of 8.2 (e.g., with phenolphthalein indicator).

The Total Acid points present in a working composition according to the invention preferably are at least, with increasing preference in the order given, 4, 6, 8, 10, 12.0, 13.0, 14.0, 14.5, 15.0, 15.3, 15.5, 15.7, or 15.9 and independently preferably are, primarily for reasons of economy, not more than, 50, 40, 35, 30, 25, 20, 18.0, 17.5, 17.0, 16.5, or 16.2.

The content of "Free Acid" of compositions according to the invention can also significantly affect their performance in forming high quality phosphate coatings. Points of Free Acid are defined in the same way as points of Total Acid, except that the titration is to a pH of 3.8 (e.g., with bromophenol blue indicator). If the pH of the composition is already 3.8 or greater, the titration is made with 0.1N strong acid instead of NaOH and is then described alternatively as negative Free Acid, or more commonly, as "Acid Consumed". Compositions according to the invention preferably have Free Acid points that are at least, with increasing preference in the order given, −1.5, −1.0, −0.80, −0.70, −0.60., −0.55, or −0.50 and independently preferably are not more than, with increasing preference in the order given, 1.5, 1.0, 0.80, 0.60, 0.50, 0.40, 0.30, 0.20, 0.15, or 0.10.

As already noted above, reducing agent component (E) is normally preferred in compositions according to the invention when concentrates are being made by dissolving MnO in phosphoric acid. If working solutions are being prepared directly, or some more readily soluble source of Mn(II) ions than MnO is used, component (E) is generally not needed. When component (E) is used, it is preferably selected from the group consisting of (i) hydroxylamine and the salts and complexes thereof that function chemically in the same manner as hydroxylamine itself when dissolved in water and (ii) ferrous ions, with the latter preferred, because it is less expensive and also effective in lower concentrations. Any water soluble salt of ferrous iron may be used as a source of ferrous ions, as may powdered metallic iron, although the latter is not usually preferred because its dissolution is more difficult. The ratio of the molar concentration of ferrous ions to the molar concentration of any MnO used in preparing a composition according to the invention preferably is at least, with increasing preference in the order given, 0.001:1.0, 0.003:1.0, 0.005:1.0, 0.006:1.0, 0.0070:1.0, 0.0075:1.0, 0.0080:1.0, 0.0083:1.0, or 0.0085:1.0 and independently preferably is, primarily for reasons of economy, not more than, with increasing preference in the order given, 0.50:1.0, 0.30:1.0, 0.10:1.0, 0.07:1.0, 0.05:1.0, 0.040:1.0, 0.030:1.0, 0.025:1.0, 0.020:1.0, 0.015:1.0, 0.012:1.0, or 0.0090:1.0. If hydroxylamine is used, it is preferably provided by hydroxylamine sulfate ($HONH_3^+HSO_4^-$), hereinafter usually abbreviated as "HAS". Independently, if hydroxylamine is used as component (E), the ratio of the molar concentration of hydroxylamine to the molar concentration of any MnO used in preparing a composition according to the invention preferably is at least, with increasing preference in the order given, 0.01:1.0, 0.03:1.0, 0.05:1.0, 0.07:1.0, 0.080:1.0, 0.090:1.0, 0.100:1.0, 0.105:1.0, 0.110:1.0, 0.115:1.0, or 0.119:1.0 and independently preferably is, primarily for reasons of economy, not more than 1.0:1.0, 0.8:1.0, 0.70:1.0, 0.60:1.0, 0.50:1.0, 0.40:1.0, 0.30:1.0, 0.25:1.0, 0.20:1.0, 0.15:1.0, or 0.13:1.0.

Optional surfactant component (F) is often preferably present in a composition according to the invention, in order to promote thorough and uniform wetting of metal substrates to be phosphated by a conversion coating composition according to the invention. A preferred type of surfactant for conversion coating compositions according to the invention is that consisting of partial esters of phosphoric acid with ether alcohols made by condensing ethylene oxide with phenol. When used, the amount of surfactant preferably is at least, with increasing preference in the order given, 0.01, 0.03, 0.05, 0.07, 0.080, 0.085, 0.090, 0.095, or 0.099 ppt and independently preferably is, primarily for reasons of economy, not more than, with increasing preference in the order given, 1.0, 0.8, 0.6, 0.4, 0.30, 0.25, 0.20, 0.17, 0.15, 0.13, or 0.11 ppt.

Optional fluoride component (G) is normally preferred in compositions according to the invention, because it has at least three beneficial possible functions: (i) counteracting the tendency of galvanized surfaces being phosphated to develop "white specking" if the phosphating compositions contain substantial amounts of chloride, as occur in some tap water supplies; (ii) providing a buffering action to maintain the acidity of the compositions in a desirable range; and (iii) promoting a desirable rate of dissolution of the metal being phosphated, as is often necessary for the phosphating process to work. Substrates of both steel and aluminum can benefit from this latter function, and in compositions according to the invention, as is known in the art for most other phosphating processes, a concentration stoichiometrically equivalent to 100 to 300 parts per million (hereinafter usually abbreviated as "ppm") of fluorine atoms is optimum for cold rolled steel substrates, while substantially higher concentrations of fluoride are preferred if aluminum is to be conversion coated. The amount used in that instance preferably should be sufficient to avoid the well known difficulties that can be caused by accumulation of aluminum ions in phosphating compositions that do not contain any complexing agent, such as fluoride, for the aluminum ions.

Optional component (H) of divalent metal ions, except for manganese and any iron added as part of the reducing agent component (E), is not generally needed in, and therefore, at least for reasons of economy, normally is preferably omitted from, compositions according to the invention, but may be useful in some special circumstances. Optional buffering agent component (J) is often preferred in a composition according to the invention, particularly if component (G) is omitted. Borates, silicates, acetates, and the corresponding acids are suitable constituents for component (J) when desired, as are many other materials well known to those skilled in the art. Optional component (K), biocide, is usually preferably present in compositions according to the invention if substantial amounts of gluconic and/or citric acids and their salts are present in the compositions, because numerous microorganisms prevalent in normal environments can utilize these organic acids as nutrients and in the process destroy the effectiveness of the compositions for their intended use and/or make the compositions repulsive to workers who use them, for example by developing a foul odor.

Preferably make-up concentrate compositions according to this invention are single package liquid concentrates, i.e., are aqueous liquids that consist of water and each of components (A) through (K), as recited above for working compositions, that are desired in the working compositions to be prepared from the make-up concentrate compositions, along with any other ingredients desired in the working compositions, except possibly for acid or alkaline materials that are not part of any of components (A) through (K) but are added to working compositions after preparation thereof to slightly less than the final desired volume, in order to adjust the Free Acid and Total Acid contents therein as defined above. Preferably, all the components except water of a make-up concentrate composition according to the invention are present therein in a concentration such that the ratio of the concentration of each component in the make-up concentrate composition to the concentration of the same component in the working composition that it is desired to prepare from the concentrate composition will be at least, with increasing preference in the order given, 5:1.0, 10:1.0, 20:1.0, 30:1.0, 40:1.0, or 50:1.0.

Preferably the concentrates are stable to storage in the temperature range from at least −20 to 50, or more preferably to 80, °C. Stability may conveniently be evaluated by measuring the free acid and total acid contents as described above. If these values have not changed after storage by more than 10% of their value before storage or by more than 0.2 points, if the absolute value before storage was less than 2.0 points, the concentrate is considered storage stable. With increasing preference in the order given, the concentrates according to the invention will be storage stable as thus defined after storage for 1, 3, 10, 30, 60, or 200 days.

The actual conversion coating forming step in a process according to this invention preferably is performed at a temperature that is at least, with increasing preference in the order given, 35°, 38°, 41°, 44°, 46°, 48°, 50°, 52°, 54°, or 55° C. and independently preferably is, primarily for reasons of economy, not more than 75°, 72°, 70°, 68°, 66°, 64°, 62°, or 61° C. The time of contact preferably should be sufficient to form a complete coating of microcrystalline phosphate over the contacted surface. When contact between a substrate to be conversion coated and a working composition according to the invention is by immersion, the time of contact preferably is at least, with increasing preference in the order given, 1.0, 1.5, 2.0, 2.2, 2.4, 2.6, 2.8, or 3.0 minutes and independently, primarily for reasons of economy, preferably is not more than, with increasing preference in the order given, 15, 10, 8, 6, 5.0, 4.5, 4.0, 3.7, 3.5, 3.3, or 3.1 minutes; when contact is by spraying, the time of contact preferably is at least, with increasing preference in the order given, 2.0, 3.0, 3.5, 4.0, 4.5, 4.7, or 4.9 minutes and independently, primarily for reasons of economy, preferably is not more than, with increasing preference in the order given, 30, 20, 15, 12, 10, 8, 7.0, 6.5, 6.0, or 5.5 minutes. Low upper limits on the time of contact are particularly preferred when the substrate surface to be coated is primarily zinciferous, because with such substrates the coating weight obtained does not increase very much after a coating that completely covers the contacted surface has been formed, whereas with steel substrates, coating weights continue to increase with time of contact, even after a coating that completely covers the contacted surface has formed.

A conversion coating formed by a process according to the invention preferably has a mass per unit area that is at least, with increasing preference in the order given, 1.5, 1.7, 1.9, 2.1, 2.3, 2.40, 2.50, 2.60, 2.70, 2.80, 2.90, or 2.97 grams per square meter of surface coated (hereinafter usually abbreviated as "$g/m^2$") and independently preferably is not more than, with increasing preference in the order given, 20, 17, 15, 13, 11, 9.0, 8.0, 7.0, 6.0, 5.0, 4.5, 4.0, 3.8, 3.6, 3.4, 3.20, or 3.10 $g/m^2$.

Before a conversion coating according to this invention is to be applied to any metal substrate, the substrate to be conversion coated is preferably thoroughly cleaned by any of various methods well known to those skilled in the art to be suitable for the particular substrate to be coated. If a conversion coating according to this invention is to be applied to a steel substrate, after being cleaned the substrate is preferably first conditioned with a conventional manganese hydrogen phosphate and alkali metal pyrophosphate conditioner for use on steel before prior art manganese phosphating. If a conversion coating according to this invention is to be applied to a predominantly zinciferous substrate such as galvanized steel, a titanium phosphate sol, also known as a Jernstedt salt, conditioning treatment is preferably used between cleaning and phosphate conversion coating according to this invention. If a conversion coating according to this invention is to be applied to a substrate containing substantial areas of both steel and galvanized steel, a mixture of the two previously specified types of conditioning treatments is preferably contacted with the substrate between cleaning and conversion coating according to the invention.

The practice of this invention may be further appreciated by consideration of the following, non-limiting examples, and the benefits of the invention may be appreciated by contrast with the comparison examples set forth below and additional comparisons known to those skilled in the art.

General Processing Conditions

The substrates used and their abbreviations as used below are shown in Table 1 below. The substrates were in the form of conventional rectangular test panels.

TABLE 1

| Substrate Metal Type | Abbreviation | Conditioner Used |
|---|---|---|
| Cold rolled steel | CRS | PARCOLENE ® M |
| Hot dip galvanized steel | HDG | FIXODINE ® Z8 |

The processing sequence used is shown in Table 2. (All materials identified herein by one of the trademarks FIXODINE®, PARCO®, or PARCOLENE® are commercially available from the Parker Amchem Division of Henkel Corp., Madison Heights, Mich. and/or Henkel Metallchimie, Düsseldorf, Germany, together with directions for using them for the process steps as noted herein.)

TABLE 2

| Process Action | Fluid Used | Temp., °C. | Time,Sec. |
|---|---|---|---|
| Spray Primary Cleaning | 21 g/L of PARCO ® Cleaner 1502 in water | 49 | 90 |
| Spray Rinse | Tap Water | 49 | 30 |
| Conditioning | See table 1 | 20–25 | 60 |
| Phosphating | See specific examples | | |
| Spray Rinse | Tap Water | 20–25 | 30 |
| Postrinsing* | PARCOLENE ® 95A Postrinse in water | 20–25 | 30 |
| Spray Rinse* | Deionized water | 20–25 | 15 |

Footnote and Abbreviations for Table 2
*These steps were optional, but if used were both used.
Temp. = Temperature; Sec. = Seconds.

Concentrate Example Group 1

Concentrates 1.1 and 1.2 according to the invention were prepared from the ingredients shown in Table 3 below.

TABLE 3

| Ingredient | Parts of Ingredient in Concentrate #: 1.1 | 1.2 |
|---|---|---|
| Tap Water | 490 | 494 |
| 75% Aqueous Solution of $H_3PO_4$ | 350 | 350 |
| 69% Aqueous Solution of $HNO_3$ | 120 | 120 |
| Hydroxylamine Sulfate | 5.0 | 0 |
| Ferrous Sulfate Heptahydrate | 0 | 1.2 |
| Manganous Oxide | 35.0 | 35.0 |

Working Composition and Process Example and Comparison Example Group 2

An Initial Working Composition 1 was prepared by dissolving the following ingredients, along with whatever mount of water was needed in addition to the ingredients listed below, to produce a total volume of 10 liters: 500 grams (hereinafter usually abbreviated as "g") of Concentrate 1.1, 10 g of $MnCO_3$, 10 g of gluconic acid, 1 g of GA-FAC™RP-710 surfactant, commercially obtained from Rhône-Poulenc and reported by its supplier to contain 99% of a mixture of partial esters of orthophosphoric acid with alcohols made by adduction of ethylene oxide with phenol, with the balance predominantly orthophosphoric acid, and sufficient 20% aqueous solution of sodium hydroxide to raise the pH of the final working composition to 3.8. The final concentration of manganese(II) cations was 1.89 ppt, and the points of Total Acid were 16.1. This working composition and modifications of it as shown in Table 4 below were used to coat rectangualr CRS test panels 10×15 centimeters in size by immersion for three (3) minutes in the working composition maintained at a temperature as shown in the Table.

TABLE 4

| Panel # | Temp., °C. | Postrinsing ? | $g/m^2$ of Phos. | Notes |
|---|---|---|---|---|
| 1.1 | 65.6 | No | 5.74 | — |
| 1.2 | 54.4 | No | 2.96 | — |
| 1.3 | 54.4 | No | 2.64 | 1 |
| 1.4 | 54.4 | Yes | 2.64 | — |
| 1.5 | 54.4 | No | 4.15 | 2 |
| 1.6 | 48.9 | No | 1.40 | 2 |
| 1.7 | 54.4 | No | 5.50 | 3 |
| 1.8 | 54.4 | No | 0.43 | 4 |

Notes for Table 4

TABLE 4-continued

| Panel # | Temp., °C. | Postrinsing ? | g/m² of Phos. | Notes |
|---|---|---|---|---|

1. Between panels 1.2 and 1.3, 20 additional panels on which coating weights were not measured were processed to age the composition. This caused the points of Total Acid to decrease slightly to 16.0. Phosphate coatings with good visual appearance were obtained on all of these 20 additional panels.
2. Between panels 1.4 and 1.5, sufficient HAS was added to the composition in which the panels were immersed to result in a concentration of 0.25% of HAS in the composition.
3. Between panels 1.6 and 1.7, additional HAS was added to the composition in which the panels were immersed, to result in a total concentration of 0.6% of HAS in the composition.
4. Between panels 1.6 and 1.7, additional HAS was added to the composition in which the panels were immersed, to result in a total concentration of 2.0% of HAS in the composition. The very sparse phosphate coating formed appeared to be iron phosphate only, with no substantial content of manganese.

Additional Abbreviation for Table 4
$g/m^2$ = grams per square meter.

Working Composition and Process Example 3

A working composition was made in the same manner as for Group 2, except that the gluconic acid and manganese carbonate were omitted, the pH was adjusted to 3.75, and the points of Total Acid were 16.4. CRS test panel 3, coated at 54.4° C. for 3 minutes by immersion, had 3.07 $g/m^2$ of phosphate coating.

Working Composition and Process Examples and Comparison Examples Group 4

Concentrate 1 as described above was diluted to give a manganese(II) concentration of 2.5–2.8 ppt and adjusted with sodium hydroxide to give Total Acid at 29.3 points and Free Acid at 1.4 points. Test panels were coated by immersion at 65.6° C. to produce results as shown in Table 5.

TABLE 5

| Panel Number | Substrate | Minutes Immersed | $g/m^2$ of Phosphate Coated |
|---|---|---|---|
| 5.1 | CRS | 3 | 2.70 |
| 5.2 | CRS | 5 | 3.42 |
| 5.3 | CRS | 10 | 6.51 |
| 5.4 | HDG | 3 | 3.02 |
| 5.5 | HDG | 5 | 3.02 |
| 5.6 | HDG | 10 | 3.02 |

The coating obtained on panel 5.1 did not completely cover the surface, but on all other panels in Table 5, the coating obtained did completely cover the surface.

The invention claimed is:

1. A process of forming a phosphate conversion coating on a steel or galvanized substrate surface, said process comprising a step of physically contacting the substrate surface at a temperature with a range from about 35° to about 75° C. with an aqueous liquid composition of matter consisting essentially of water and:

(A) from about 0.80 to about 2.7 ppt of dissolved divalent manganese cations;

(B) from about 9 to about 30 ppt of dissolved phosphate anions;

(C) from about 2.0 to about 10 mM of a dissolved component selected from the group consisting of organic acids and anions thereof that (1) contain at least two moieties per molecule that are selected from the group consisting of (1.1) carboxyl and carboxylate moieties, (1.2) hydroxyl moieties that are not part of a carboxyl moiety, and (1.3) phosphonic acid and phosphonate moieties and (2) are not part of either component (A) or component (B);

(D) a component of nitric acid, and, optionally, other dissolved acids that are not part of any of the previously recited components; and, optionally, one of more of the following components:

(E) a component of dissolved reducing agent and/or reaction products therefrom that are not part of any of the previously recited components;

(F) a component of surfactant that is not part of any of the previously recited components;

(G) a dissolved component selected from the group consisting of simple and complex anions that contain fluorine atoms and are not part of any of the previously recited components;

(H) a component of dissolved metal cations, with a valence of at least two, that are not part of any of the previously recited components;

(J) a component of buffering agents that are not part of any of the previously recited components; and (K) a component of biocides that are not part of any of the previously recited components, wherein, in said aqueous liquid composition: the pH is at least 3; component (A) is present in a ratio to component (B) of from about 1.0:30 to about 1.0:7.0; the Total Acid points are from about 8 to about 25; and the Free Acid points are from about −1.0 to about 1.0.

2. A process according to claim 1, wherein, in said aqueous liquid composition: component (A) is present at a concentration from about 1.00 to about 2.7 ppt and in a ratio to component (B) of from about 1.0:24 to about 1.0:9.0; component (B) is present at a concentration from about 10.5 to about 21 ppt; component (C) is present at a concentration from about 2.5 to about 7.0 mM; the Total Acid points are from about 12 to about 20; and the Free Acid points are from about −0.80 to about 0.60.

3. A process according to claim 2, wherein, in said aqueous liquid composition: component (A) is present at a concentration from about 1.20 to about 2.3 ppt and in a ratio to component (B) of from about 1.0:21 to about 1.0:10.5; component (B) is present at a concentration from about 11.5 to about 17.0 ppt; component (C) is present at a concentration from about 3.0 to about 7.0 mM and is selected from the group consisting of gluconic acid, citric acid, heptogluconic acid, and the salts of all these acids; the Total Acid points are from about 14 to about 18.0; the Free Acid points are from about −0.60 to about 0.50; and the composition contains, as at least part of component (F), from about 0.05 to about 0.25 ppt of partial esters of phosphoric acid with ether alcohols made by condensing ethylene oxide with phenol.

4. A process according to claim 1, wherein, in said aqueous liquid composition: component (A) is present at a concentration from about 1.40 to about 2.3 ppt and in a ratio to component (B) of from about 1.0:16 to about 1.0:12.0; component (B) is present at a concentration from about 11.5 to about 15.0 ppt; component (C) is present at a concentration from about 4.3 to about 5.8 mM and is selected from gluconic acid and its salts; the Total Acid points are from about 14.5 to about 17.0; the Free Acid points are from about −0.50 to about 0.10; the composition contains from about 0.08 to about 0.15 ppt of partial esters of phosphoric acid with ether alcohols made by condensing ethylene oxide with phenol; and the composition contains dissolved iron cations in a concentration that has a molar ratio to the concentration of dissolved manganese atoms of from about 0.006:1.0 to about 0.020:1.0.

5. A process according to claim 4, wherein the aqueous liquid composition is maintained within a temperature range from about 55° to about 61° C. for a time from about 2.8 to about 5.5 minutes, so as to deposit on the substrate surface a phosphate conversion coating having a mass per unit area in the range from about 2.70 to about 8.0 $g/m^2$.

6. A process according to claim 3, wherein the aqueous liquid composition is maintained within a temperature range from about 55° to about 61° C. for a time from about 2.8 to about 5.5 minutes, so as to deposit on the substrate surface a phosphate conversion coating having a mass per unit area in the range from about 2.70 to about 6.0 $g/m^2$.

7. A process according to claim 2, wherein the aqueous liquid composition is maintained within a temperature range from about 55° to about 61° C. for a time from about 2.8 to about 5.5 minutes, so as to deposit on the substrate surface a phosphate conversion coating having a mass per unit area in the range from about 2.70 to about 6.0 $g/m^2$.

8. A process according to claim 1, wherein the aqueous liquid composition is maintained within a temperature range from about 55° to about 61° C. for a time from about 2.8 to about 5.5 minutes, so as to deposit on the substrate surface a phosphate conversion coating having a mass per unit area in the range from about 2.70 to about 6.0 $g/m^2$.

* * * * *